US005833962A

United States Patent [19]

Chen

[11] Patent Number: 5,833,962

[45] Date of Patent: Nov. 10, 1998

[54] LIPSTICK CASE WITH AN AUTOMATICALLY SWINGING OPEN CAP

[76] Inventor: Sin-Hsiung Chen, P.O. Box 90, Tainan, Taiwan

[21] Appl. No.: 980,769

[22] Filed: Dec. 1, 1997

[51] Int. Cl.[6] ..... A61K 7/04; A45D 40/04; A45D 40/06; B43K 19/00

[52] U.S. Cl. ..... 424/61; 401/49; 401/68

[58] Field of Search ..... 424/61; 401/49, 401/68

[56] References Cited

U.S. PATENT DOCUMENTS 5,178,478 1/1993 Ryder ..... 401/195

*Primary Examiner*—Thurman K. Page
*Assistant Examiner*—Sharon Howard

[57] ABSTRACT

A lipstick case with an automatically swinging open cap includes a rotatable base, a housing, a connect sleeve, a lipstick seat and a cap unit. The housing fits around an upper portion of the rotatable base, and the connect sleeve fits in the rotatable base and has its top fixed and rotate with the housing. The lipstick seat is disposed in the connect sleeve, mounted with a lipstick. The rotatable base can be rotated counterclockwise relative to the housing, forcing the lipstick seat to rise up and forcing the cap unit to move down relative to the housing to let a cap body closing on an upper mouth of the housing to move down and swing up to open the upper mouth for an upper end of the lipstick to expose out for use.

2 Claims, 5 Drawing Sheets

LIPSTICK CASE WITH AN AUTOMATICALLY SWINGING OPEN CAP

BACKGROUND OF THE INVENTION

This invention relates to a lipstick case with an automatically swinging open cap, particularly to one having its cap body automatically swinging open to let a lipstick raised up by rotating a rotatable base to exposed out of an upper mouth of a housing fitting around the rotatable base.

Makeup is quite indispensable for a large part of the female to do almost every day, and a lipstick is carried out with other cosmetics for supplementary makeup when necessary. And common lipstick cases have a separate cap to be removed before using a lipstick contained in the case. Especially it is not convenient, if a mirror is to be held in one hand, and a lipstick is to be held with the other hand for use.

SUMMARY OF THE INVENTION

The purpose of the invention is to offer a lipstick case with a cap automatically swung open.

A feature of the invention is a rotatable base provided with two helical grooves formed in an inner surface and a helical recessed route formed in an outer surface and having an opposite direction against the helical grooves.

Another feature of the invention is a housing provided with a vertical opening with an upper mouth.

One more feature of the invention is a cap unit, which has a cap body closing on the upper mouth of the housing and loaded by a spring to face down, a slide plate connected under the cap body to engage and move up and down along the opening of the housing, and a projection fixed on an inner surface of the slide plate to fit in the helical recessed route of the rotatable base.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
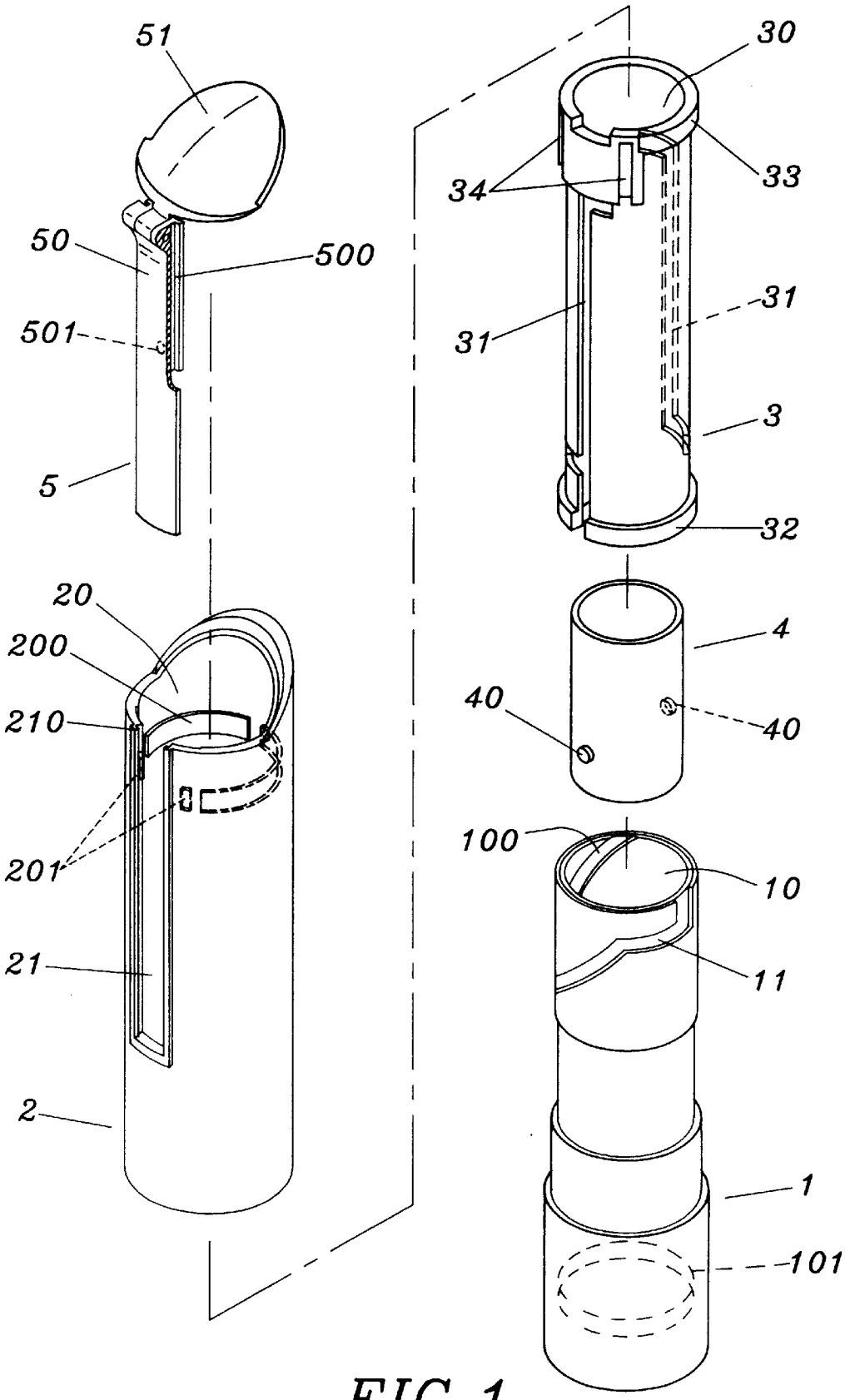
FIG. 1 is an exploded perspective view of a lipstick case with an automatically swinging open cap in the present invention.

A preferred embodiment of a lipstick with an automatically swinging open case in the present invention, as shown in FIG. 1, includes a rotatable base 1, a housing 2, a connect sleeve 3, a lipstick seat 4 and a cap unit 5 as main components.

The rotatable base 1 is shaped cylindrical, having a hollow interior 10 opening to an upper side and a closed bottom side, two helical grooves 100, 100 formed in an inner surface defining the interior 10, an annular groove 101 formed in a lower portion of the inner wall, a helical recessed route 11 formed in an outer surface having an opposite direction relative to the helical grooves 100, 100.

The housing 2 fits around an upper substantial portion of the rotatable base 1, rotatable in a counter-direction relative to the rotatable base 1, and having a hollow interior 20, a horizontal support edge 200 and two projections 201, 201 formed in an inner upper surface, a vertical slide opening 21 formed in an wall defining the hollow interior 20, a position edge 210 formed along two sides of the opening 21.

The connect sleeve 3 is disposed in the hollow interior 10 of the rotatable base 1, having its upper end fixed with the housing 2 to rotate together with the housing 2 in the same direction, provided with a hollow interior 30, two opposite vertical position slots 31, 31 formed in the wall defining the interior 20, a lower flange 32 formed in a bottom end, an upper flange 33 formed in a top end, and two parallel vertical engage grooves 34, 34 formed in an upper outer surface.

The lipstick seat 4 is disposed in the hollow interior 30 of the connect sleeve 3, having two opposite projections 40, 40 formed on an outer surface.

The cap unit 5 is combined with the housing 2 on the vertical opening 21, covering on an upper mouth of the interior 20 of the housing 2, having a slide plate 50 able to slide along the opening 21, a vertical fitting groove 500 respectively formed in the two sides of the slide plate 50, a projection 501 formed on an inner surface of the slide plate 50 and fitting and moving in the helical recessed route 11 of the rotatable base 1, a cap body 51 pivotally connected with an upper end of the slide plate 50 and loaded down by a spring to cover on the upper mouth of the housing 2.

Figure 2:
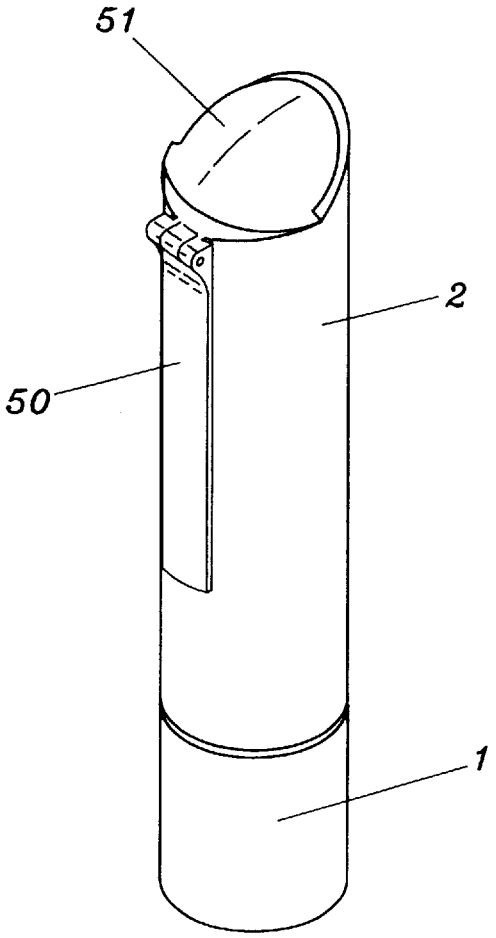
FIG. 2 is a perspective view of the lipstick case with an automatically swinging open cap in the present invention.
Figure 3:
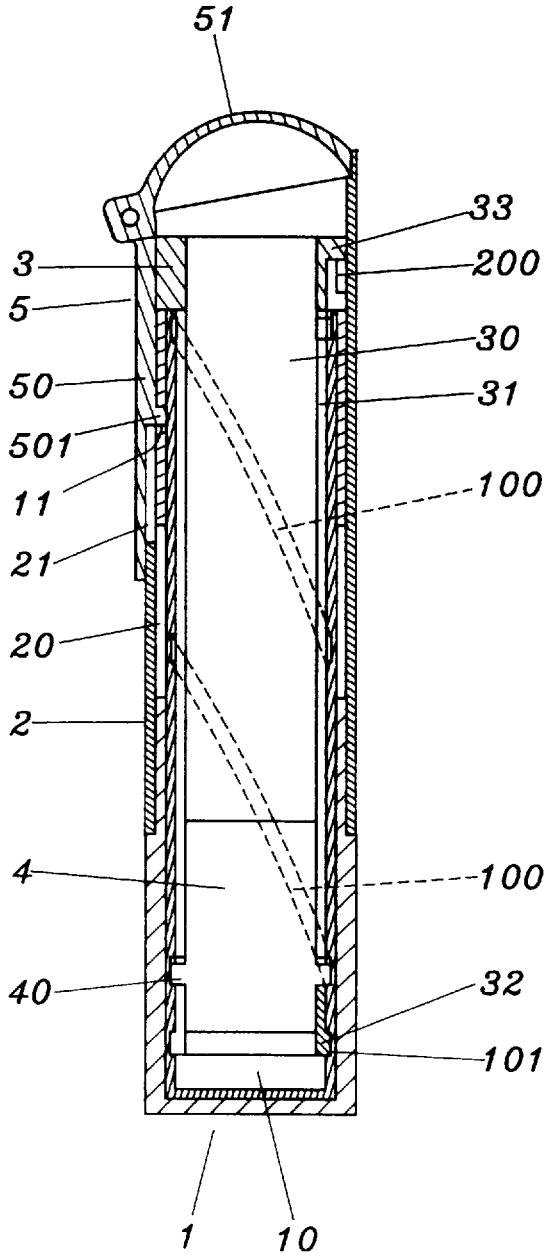
FIG. 3 is a cross-sectional view of the lipstick case with an automatically swinging open cap in the present invention.

In assembling, referring to FIGS. 1, 2 and 3, firstly, the lipstick seat 4 is placed from under in the hollow interior 30 of the connect sleeve 3, with the projections 40, 40 fitting in the vertical position slots 31, 31 of the connect sleeve 3. Next, the slide plate 50 of the cap unit 5 is inserted from an upper mouth in the opening 21, with the two fitting grooves 500, 500 engaging respectively the protruding edges 210, 210 of the opening 21. Then the connect sleeve 3 together with the lipstick seat 4 is inserted from above in the interior 20 of the housing 2, with the upper flange 33 supported on the support edge 200 of the housing 2, with the two vertical engage grooves 34, 34 engaging the two projections 201, 201, thus preventing the connect sleeve 3 from rotating together with the housing 2, and permitting the lower portion of the connect sleeve 3 extending and exposing out of the bottom of the housing 2. Next, the connect sleeve 3 is inserted from above in the hollow interior 10 of the base 1, with the housing 2 fitting around the the outer surface of the base 2, with the lower flange 32 engaging the annular groove 101 of the base 1 to keep the connect sleeve 3 combined with the rotatable base 1 in place so that the connect sleeve 3 and the rotatable base 1 may be rotated in an opposite direction to each other. Further, the two opposite projections 40, 40 of the lipstick seat 4 fitting in the two opposite position slots 31, 31 of the connect sleeve 3 and also engaging respectively the two helical grooves 100, 100 of the base 1. And the projection 501 of the slide plate 50 of the cap unit 5 extends in the opening 21 and engages the helical recessed route 11 of the rotatable base 1, with the cap body 51 covering elastically up the upper mouth of the housing 21. So the lipstick case is finished in its assemblage.

Figure 4:
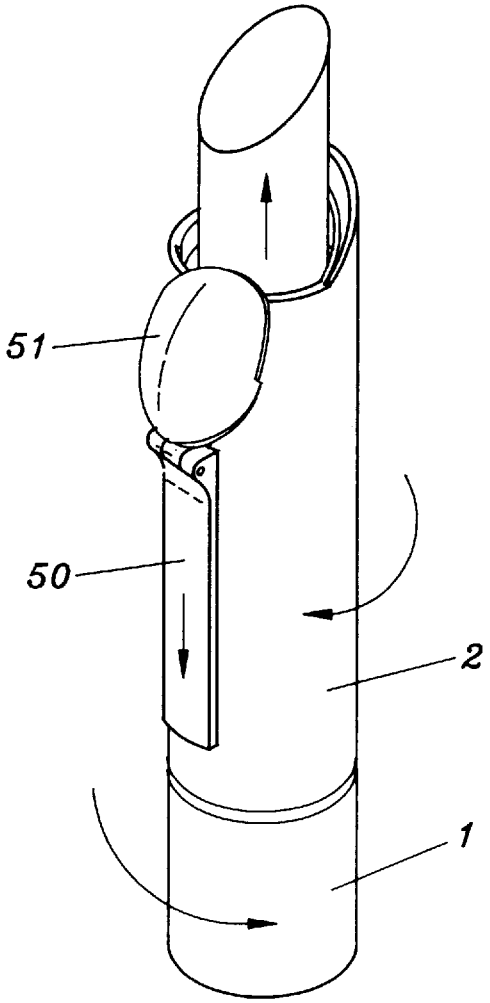
FIG. 4 is a perspective view of the lipstick case with an automatically swinging open cap swung open in the present invention; and, FIG. 5 is a cross-sectional view of FIG. 4 in the the present invention.
Figure 5:
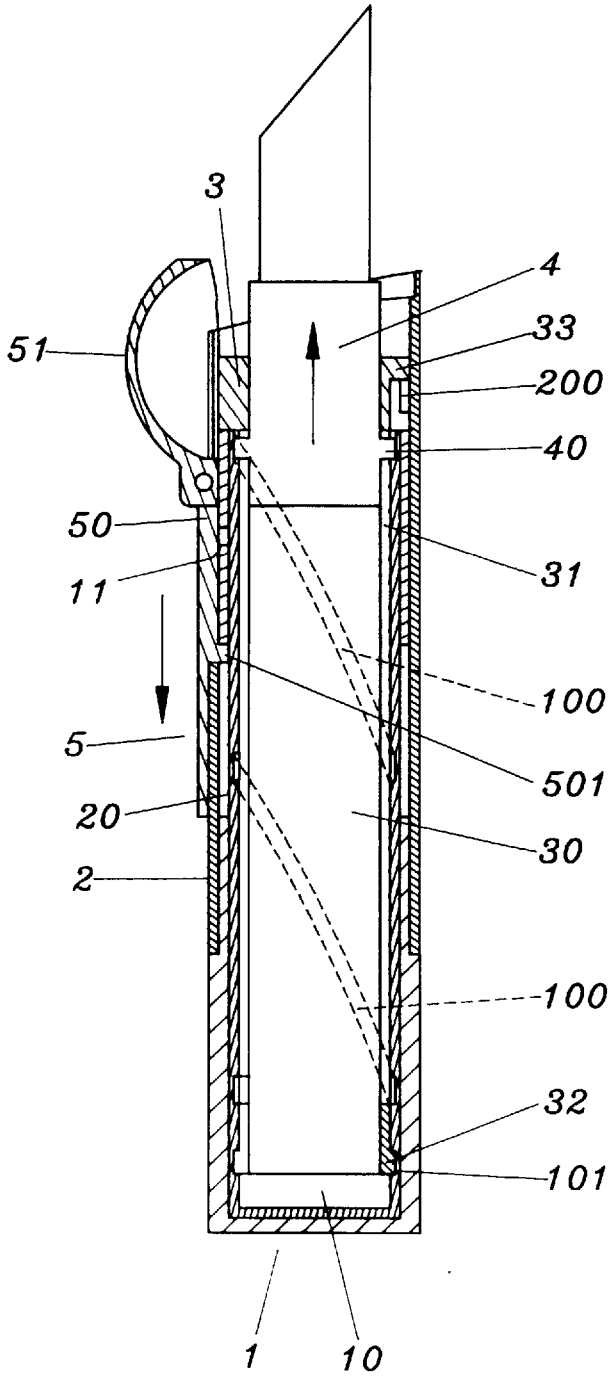

In using the lipstick mounted on the rotatable base 1, referring to FIGS. 4 and 5, the lower portion of the rotatable base 1 is rotated counterclockwise, forcing the lipstick seat 40 rise up relative to the connect sleeve 3 by means of the two opposite projections 40, 40 moved up along the two slide slots 31, 31 of the connect sleeve 3 by the two helical grooves 100, 100 of the rotatable base 1 rotated. Meanwhile, the projection 501 of the cap unit 5 is facing the opening 21 of the housing 2 and further fitting in the helical recessed route 11 of the rotatable base 1, the cap unit 5 may be moved down by means of the projection 501 moving along the helical route 11 during counterclockwise rotation of the rotatable base 1. Then the slide plate 50 moves down along the opening 21 by means of the two position grooves 500, 500 of the slide plate 30 engaging and moving along the position edges 210 ,210 of the housing 2. Therefore, the cap body 1 loaded by a spring may be swung upward and pulled down at the same time by the slide plate 50, resting on an outer surface of the housing 2. At the same time, the lipstick on the lipstick seat 4 moves up gradually during the swinging of the cap body 51 to expose out of the upper mouth of the housing 2, ready for use.

If the lipstick on the lipstick seat 4 is needed to be shrunk into a lower position in the connect sleeve 3, referring to FIGS. 2 and 3, the lower portion of the rotatable base 1 is rotated clockwise, forcing the lipstick seat 4 move down relative to the connect sleeve 3, by means of the projections 40, 40 moving down along the helical grooves 100, 100 of the rotatable base 1 rotated. Meanwhile the slide plate 50 of the cap unit 5 is moved up by means of the projection 501 engaging and moving along the helical route 11, forcing the cap body 51 move up to leave the outer surface of the housing 2 and swing down to close up the upper mouth of the housing 2 by the spring pressing down the cap body 51.

As described above, the lipstick case in the invention has its lipstick raised up and the cap body swung up at the same time by rotating the lower portion of the rotatable base for use, very convenient, without need to take off a cap.

While the preferred embodiment of the invention has been described above, it will be recognized and understood that various modifications may be made therein and the appended claims are intended to cover all such modifications which may fall within the spirit and scope of the invention.

What is claimed is:

1. A lipstick case with an automatically swinging open cap comprising:

a rotatable base having a hollow interior with an open upper mouth and a closed bottom side, and two helical grooves formed in an inner surface of the wall defining said hollow interior;

a housing fitting around an upper substantial portion of said rotatable base, able to rotate in counter-direction relative to said rotatable base, and having a hollow interior;

a connect sleeve disposed in said hollow interior of said rotatable base, having its top end fixed securely with said housing to rotate together with said housing provided with a hollow interior and two opposite vertical position slots formed in the wall defining said hollow interior;

a lipstick seat disposed in said hollow interior of said connect sleeve, having two opposite projections on its wall defining said hollow interior, said two projections respectively protruding in said two position slots of said connect sleeve and fitting in said two helical grooves of said rotatable base; and, characterized by said rotatable base further provided with a helical recessed route formed in the upper portion in an opposite direction to said two helical grooves thereof, said housing further provided with a vertical opening with an upper mouth formed in a wall defining said hollow interior, a cap unit provided to engage with said opening of said housing and having a cap body loaded by a spring to cover on said upper mouth of the said housing, said cap unit further having a slide plate connected under said cap body and fitting with and moving up and down along said opening, a projection fixed on an inner surface of said slide plate to fit in said helical recessed route of said rotatable base; said rotatable base able to be rotated counterclockwise relative to said housing, forcing said projection of said slide plate of said cap unit slide along said helical recessed route of said rotatable base, with said slide plate sliding down along said opening of said housing so that said cap body may be pulled down and swung up by said spring and separating from said upper upper mouth of said housing, or with said slide plate sliding up along said opening of said housing so that said cap body may be lifted up to swing down to close up said upper mouth of said housing, and said lipstick seat lifted up relative to said connect sleeve by counterclockwise rotation of said rotatable base for a lipstick mounted on said lipstick seat extend up out of said upper mouth of said housing for use.

2. The lipstick case with an automatically swinging open cap as claimed in claim 1, wherein said opening of said housing is further provided with a position edge respectively formed at two vertical sides thereof, and said slide plate of said cap unit is provided with a position groove respectively at two vertical sides, said position edges of said opening engaging said position grooves of said slide plate so that said slide plate may slide up and down along said opening.

* * * * *